US006860765B1

(12) United States Patent
Spink, Jr.

(10) Patent No.: US 6,860,765 B1
(45) Date of Patent: Mar. 1, 2005

(54) ELECTRICAL CONNECTOR FOR TRANSMITTING POWER

(75) Inventor: William E. Spink, Jr., Laguna Niguel, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/678,985

(22) Filed: Oct. 2, 2003

(51) Int. Cl.[7] ..... H01R 13/64
(52) U.S. Cl. ..... 439/680; 439/83
(58) Field of Search ..... 439/680, 83, 79

(56) References Cited

U.S. PATENT DOCUMENTS 5,037,316 A 8/1991 Fukushima et al.
5,199,884 A * 4/1993 Kaufman et al. ..... 439/74
5,257,948 A 11/1993 Peterson
5,342,221 A 8/1994 Peterson
5,938,456 A * 8/1999 Kozel et al. ..... 439/83
6,095,854 A 8/2000 Sommer et al.
6,135,822 A * 10/2000 Hwang ..... 439/680
6,159,054 A * 12/2000 Ko ..... 439/680
6,168,475 B1 * 1/2001 Ko ..... 439/680
6,174,197 B1 * 1/2001 Hirata et al. ..... 439/541.5
RE37,296 E 7/2001 Peterson
6,338,634 B1 * 1/2002 Yu ..... 439/83
6,364,718 B1 4/2002 Polgar et al.
6,382,989 B1 * 5/2002 Yu ..... 439/83
6,575,774 B2 * 6/2003 Ling et al. ..... 439/108

* cited by examiner

*Primary Examiner*—Gary Paumen
(74) *Attorney, Agent, or Firm*—Wei Te Chung

(57) ABSTRACT

A power connector (10, 110) includes an insulative housing (12, 112) defines a number of passageways (20, 120) and a number of conductive contacts (14, 114) each having a mating portion (24, 124) received in corresponding passageways and a tail portion (26, 126) extending below a bottom surface (16, 116) of the housing. The tail portions extend in a single plane parallel with the bottom surface of the housing such that they are surface mountable onto corresponding solder pads on the substrate.

11 Claims, 6 Drawing Sheets

ELECTRICAL CONNECTOR FOR TRANSMITTING POWER

BACKGROUND OF THE INVENTION

1. Field of the Invention

The present invention relates to an electrical connector that is surface mountable onto a substrate for transmitting power between the substrate and a power supply.

2. Description of the Related Art

U.S. Pat. No. 5,257,948 discloses a right-angle board mounting connector including an insulative housing, a number of conductive contacts and a pair of board-locks attached to the housing. The housing includes a front surface adapted for mating with a complementary connector, a rear surface distanced from the front surface and a bottom surface confronting a substrate when the connector lies on the substrate. The housing defines a plurality of passageways in the front surface and extending to the rear surface. The contacts are right-angle type and each has a mating portion at one end thereof received in corresponding ones of the passageways and a tail portion at another end thereof extending beyond the bottom surface of the housing. The tail portions insert into corresponding through-holes in the substrate and then solders are applied thereto to secure the tail portions in the through-holes. The board-locks each have arms extending downward beyond the bottom surface of the housing so that the arms may be engageably inserted into corresponding through-holes in the substrate to locate the connector in desired position.

One of the disadvantages of the above connector is that the substrate has to define through-holes for the contact tail portions of the above connector, which adds difficulties of the arrangement of conductive traces in the substrate because the conductive traces can not be placed through the through-holes. So, it is desirable to design a connector having conductive contact tails that are mountable on a surface of a substrate for transmitting power therethrough.

SUMMARY OF THE INVENTION

An object of the present invention is to provide a power connector having contact tails that are surface mountable onto conductive pads on a substrate for transmitting power between the substrate and a power supply.

To obtain the above object, an electrical connector includes a housing of insulative material, a plurality of conductive contacts attached to the housing for transmitting power and a pair of metal panels attached to opposite ends of the housing. The housing includes a bottom surface to face a substrate that the connector is surface mountable to, a mating surface to engage with a complementary connector and defines a plurality of passageways in the mating surface and through the housing. Each contact has a mating portion at one end thereof and a tail portion at another end thereof. The mating portions are received in the passageways and the tail portions extend parallelly with the bottom surface of the housing and locate in a single plane below the bottom surface of the housing. The metal panels each have a section parallelly extending in the single plane so that they are surface mountable onto solder pads on a substrate together with the tail portions of the contacts. Stand-offs are provided on the bottom surface of the housing to support the connector when the tail portions and the metal panels are soldered. This invention provides two types of power connectors, wherein one type is vertically mounted onto the substrate with the mating portions of the contacts perpendicular with the substrate, the other type lies on the substrate with the mating portions of the contacts parallel with the substrate. Since the contact tail portions are mountable on a surface of the substrate and do not insert through the substrate, conductive traces of the substrate need not be specifically placed to avoid through-holes as the connector described in the background section. So, problems in the prior art connector are successfully solved.

Other objects, advantages and novel features of the invention will become more apparent from the following detailed description of the present embodiment when taken in conjunction with the accompanying drawings.

DESCRIPTION OF THE PREFERRED EMBODIMENT

Figure 1:
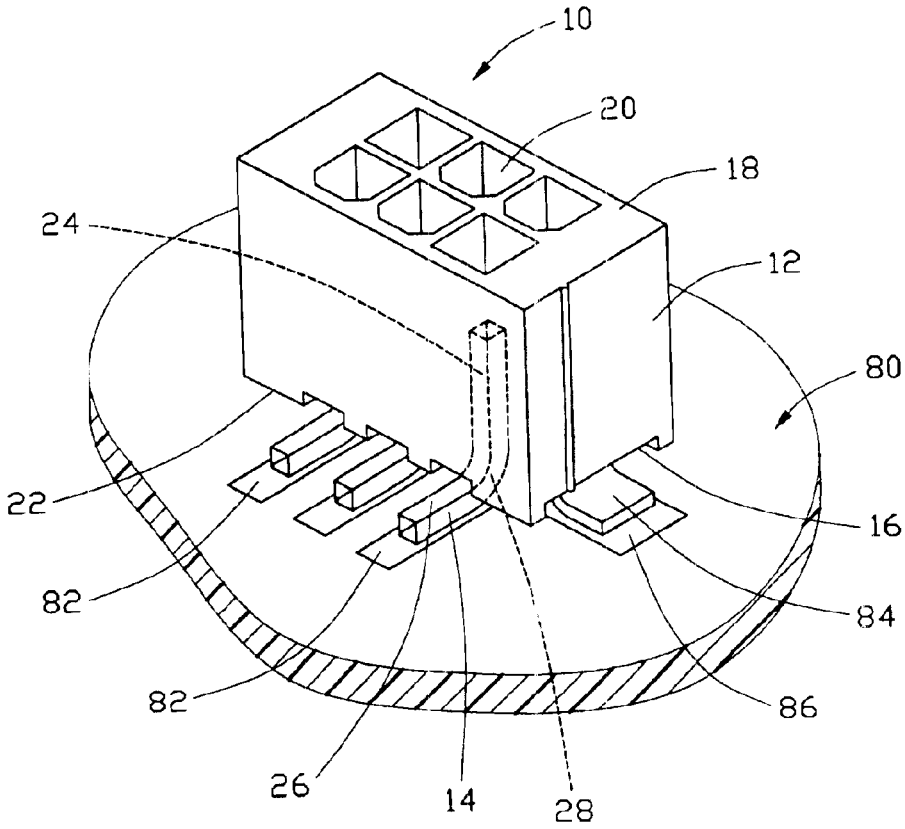
FIG. 1 is a top perspective view of an electrical connector in accordance with a first embodiment of the present invention mounted on a printed board.
Figure 2:
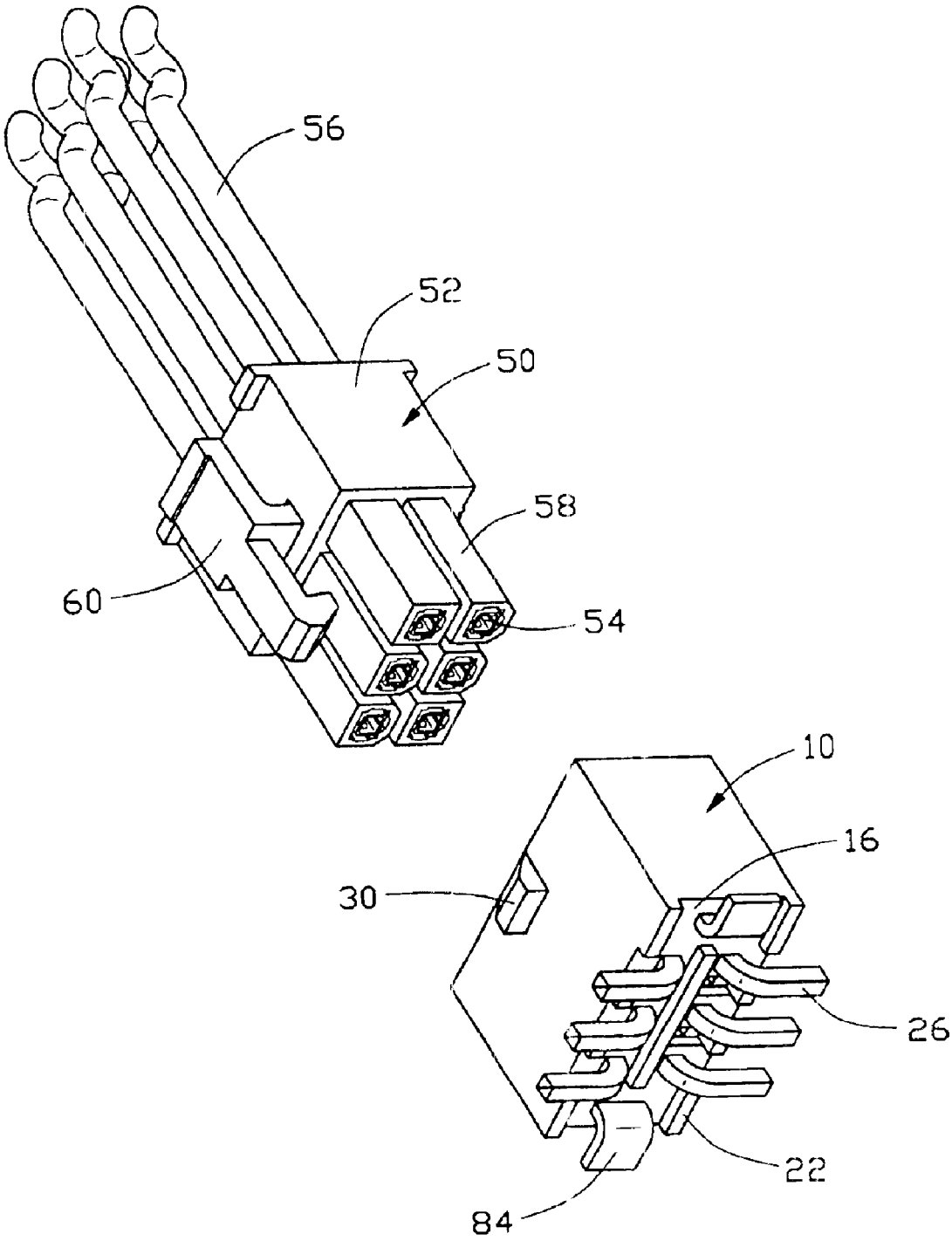
FIG. 2 is a bottom perspective view of the electrical connector in FIG. 1 and a complementary connector before mated.
Figure 3:
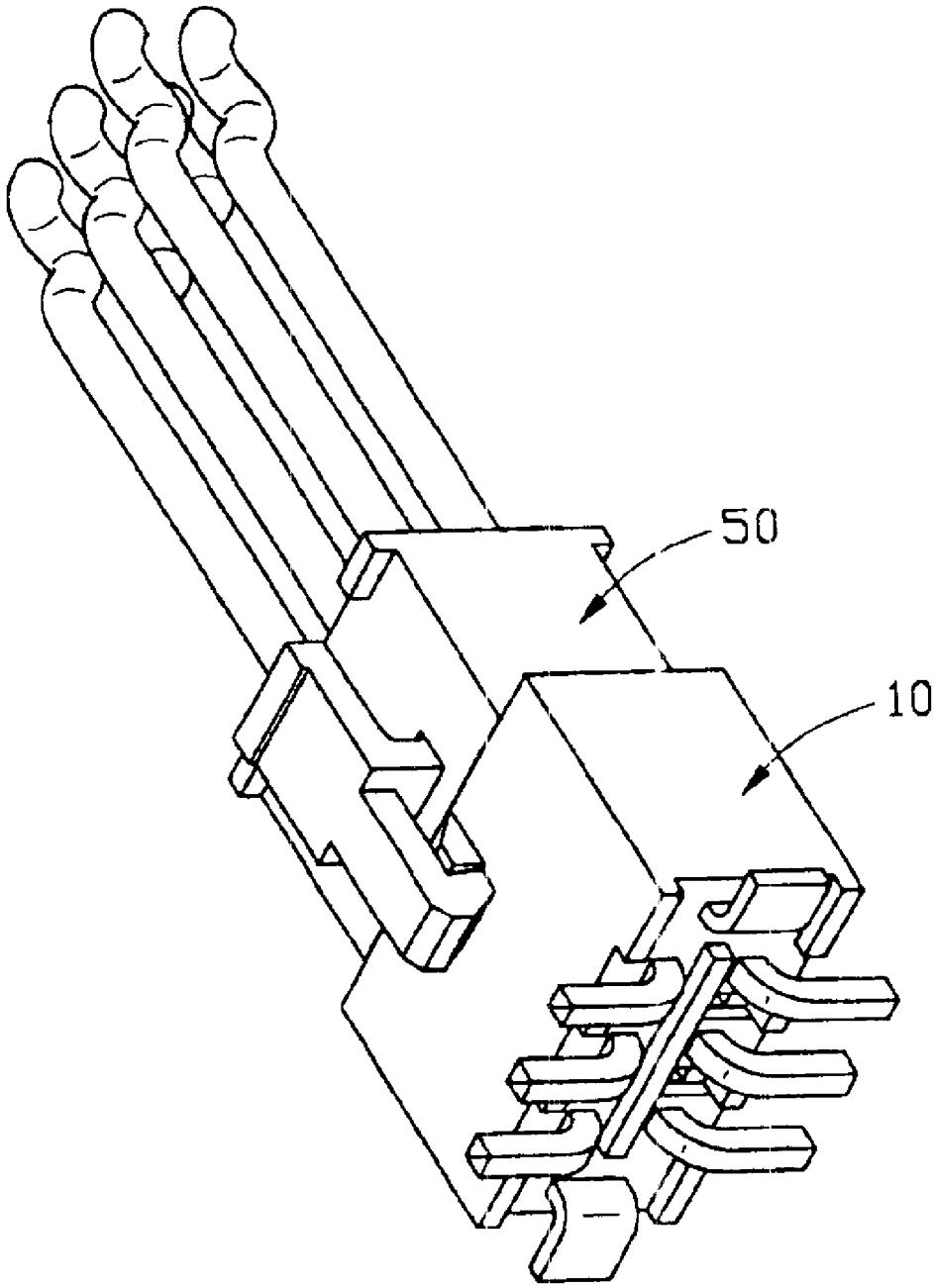
FIG. 3 is similar to FIG. 2 but the connectors are mated with each other.

FIGS. 1–3 illustrate a first embodiment of a connector system including an electrical connector, header connector 10, of the present invention and a complementary connector, cable end connector 50. The header connector 10 includes a housing of insulative material 12 and a number of contact of conductive material 14 assembled to the housing 12. The housing 12 has a bottom surface 16 facing a substrate 80 (sometimes called printed board) after the header connector 10 is mounted onto the substrate 80 and an opposite top surface 18 and defines a plurality of passageways 20 between the bottom and top surfaces 16, 18. These passageways 20 are arranged in rows, for example two rows and each row has three passageways 20. The passageways 20 impress at least two different geometries on the top surface 18 of the housing 12 such that there is a pole that may be inserted into the passageways having one of the geometry but may not be inserted into the passageways having the other geometry. Several stand-offs 22 are provided on the bottom surface 16 of the housing 12. Each contact 14 includes a contacting portion 24 at one end thereof, a tail portion 26 at another end thereof and an intermediate portion 28 between the contacting portion 24 and the tail portion 26. The contacting portions 24 are received in corresponding ones of the passageways 20, respectively. Bottom portions of the tail portions 26 are generally located in a single plane below and parallel with the bottom surface 16 of the housing 12 such that the tail portions 26 are surface mountable onto solder pads 82 of the substrate 80. A pair of conductive panels 84 are respectively assembled to two opposite elongate ends of the housing 12 and each has a section downward extending beyond the bottom surface 16 to the single plane that bottom portions of the tail portions 26 are located in. The conductive panels 84 are surface mountable onto solder pads 86 on the substrate 80 to secure the header connector 10 in position.

Referring to FIGS. 2 and 3, the cable end connector 50 includes a housing of insulative material 52, a plurality of contacts of conductive material 54 retained to the housing 52 and a corresponding number of cables 56 electrically connecting to corresponding ones of the contacts 54. The housing 52 provides a number of poles 58 at a front portion thereof with the contacts 54 therein. The poles 58 are configured in accordance with the geometries imposed on the top surface 18 by the passageways 20 such that the cable end connector 50 is engageable with the header connector 10. The housing 52 of the cable end connector 50 provides a moveable latch 60 on a top thereof and the housing 12 of the header connector 10 provides a block 30 on an out surface thereof, and the latch 60 engages with the block 30 after the cable end connector 50 completely mates with the header connector 10 to keep the connectors mated.

Figure 4:
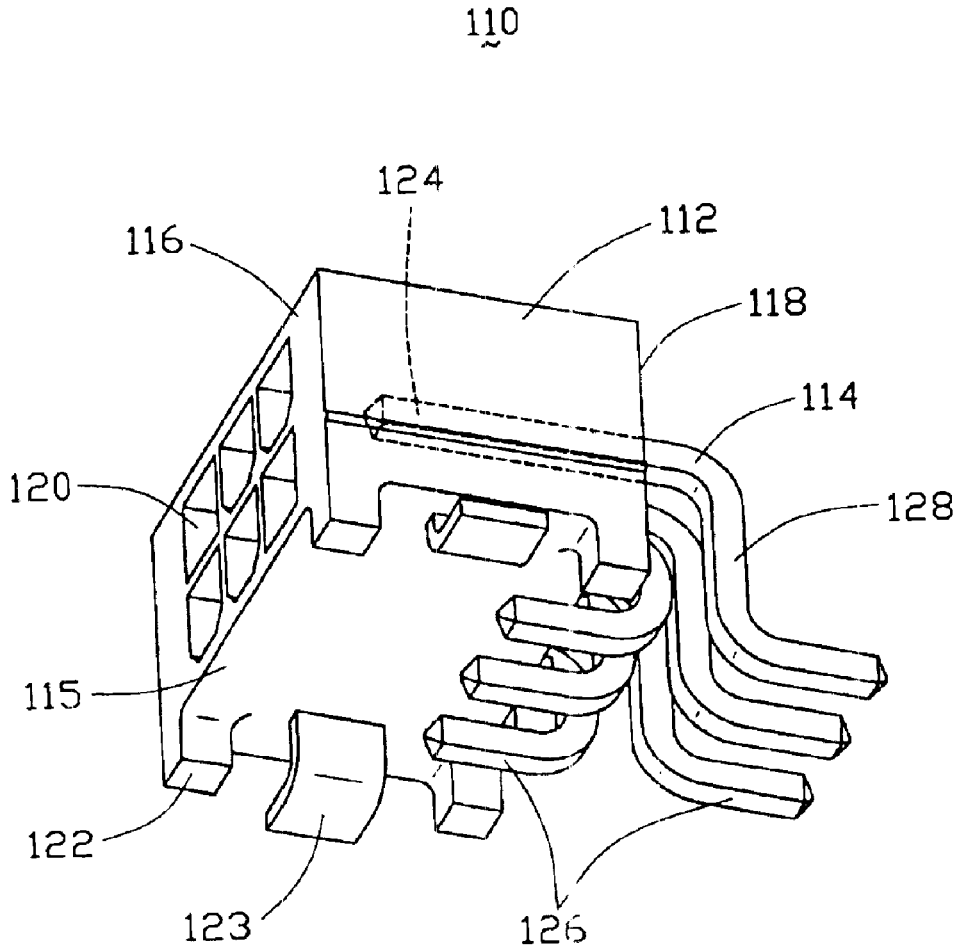
FIG. 4 is a bottom perspective view of an electrical connector in accordance with a second embodiment of the present.
Figure 5:
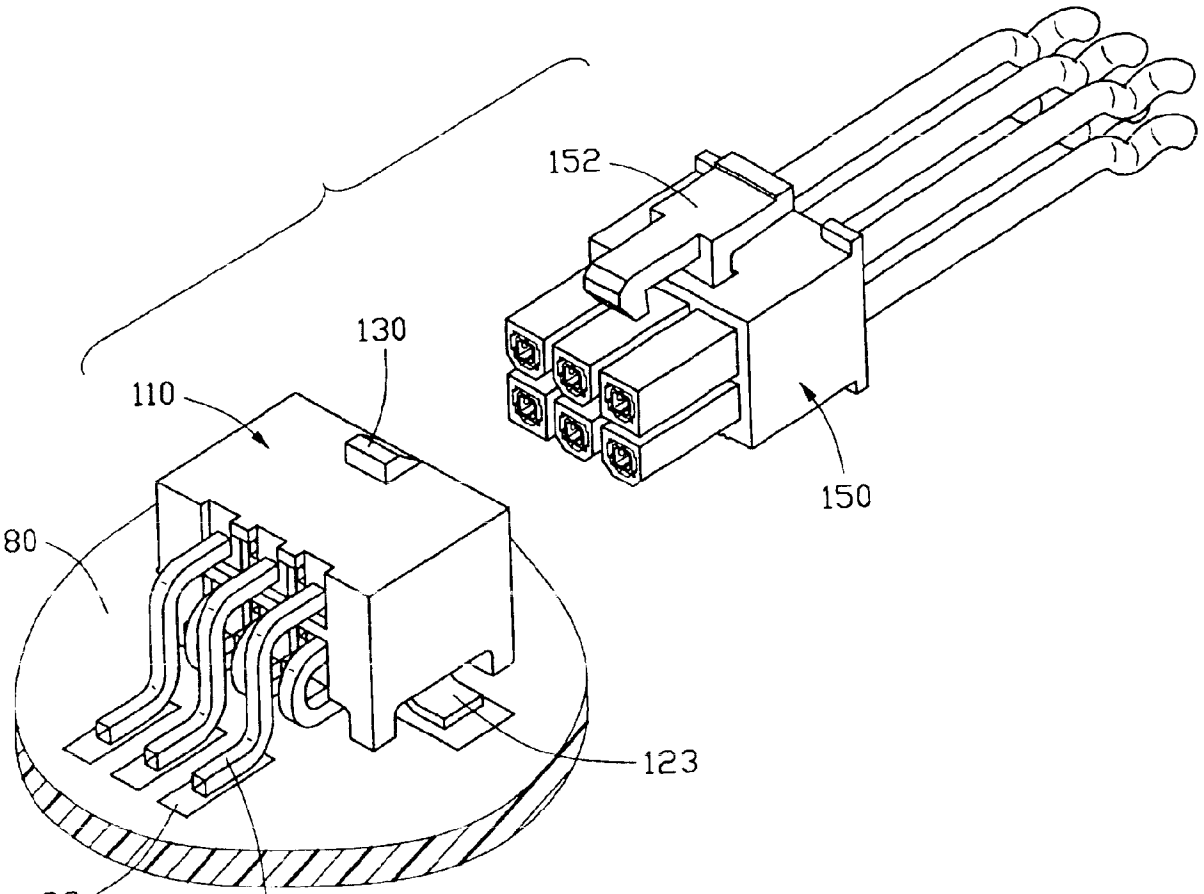
FIG. 5 is a top perspective view of the electrical connector in FIG. 4 mounted on a printed board and a complementary connector before mated.
Figure 6:
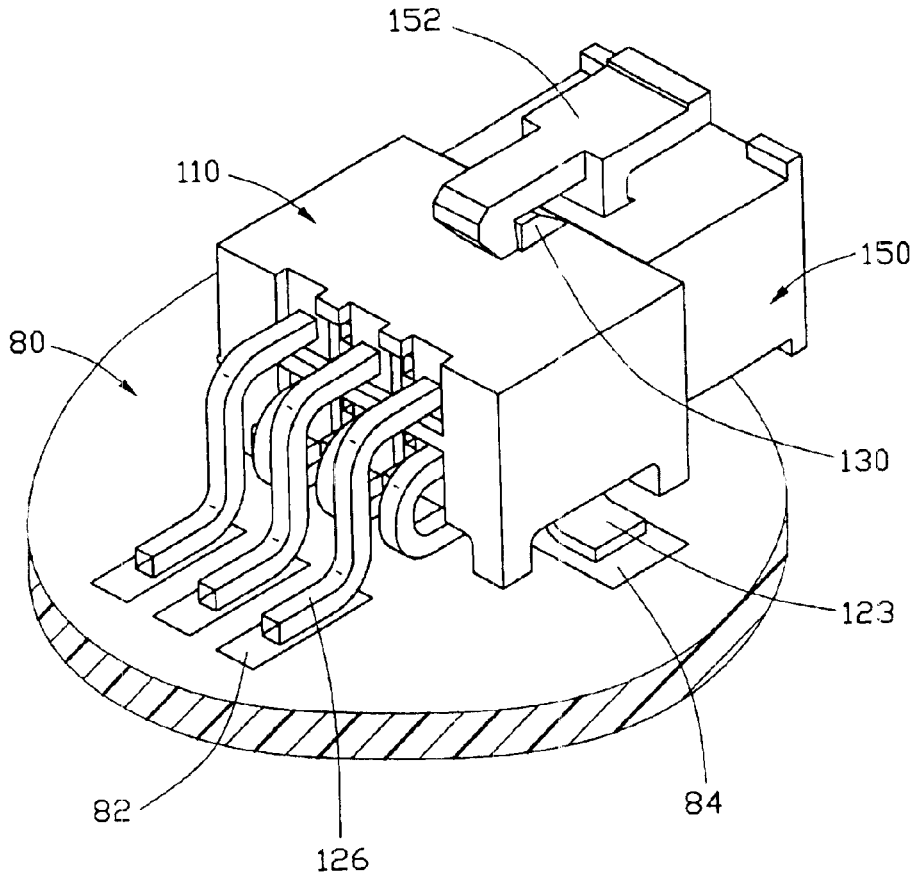
FIG. 6 is similar to FIG. 5 but the connectors are mated with each other.

FIGS. 4–6 illustrate a second embodiment of the connector system including a header connector 110 and a cable end connector 150 engageable with each other. The cable end connector 150 is exactly the same as the cable connector 50 defined above. The header connector 110 is similar to the header connector 10 but the header connector 10 "stands" on the substrate 80 and engages with the cable end connector in a direction perpendicular to the substrate 80 while the header connector 110 "lies" on the substrate 80 and engages with the cable end connector in a direction parallel with the substrate 80. The header connector 110 includes a housing 112 of insulative material, a plurality of contacts 114 of conductive material attached to the housing 112. The housing 112 has a bottom surface 115 facing the substrate 80 when the header connector 110 is mounted onto the substrate, a front surface 116 engageable with the cable end connector 150, a rear surface 118 distanced from the front surface 116 and defines a plurality of passageways 120 between the front and rear surfaces 116, 118. The housing provides four stand-offs 122 on the bottom surface 115 thereof. Each contact 114 includes a contacting portion 124 at one end thereof, a tail portion 126 at another end thereof and an intermediate portion 128 between and connecting the contacting portion 124 to the tail portion 126. The contacting portions 124 are received in corresponding ones of the passageway 120 while the intermediate portions 128 extend rearward beyond the rear surface 118 such that the tail portions 126 locate out of the housing. The tail portions 126 are arranged in two rows, and one row of the tail portions 126 reversely extend toward the front surface 116 of the housing 112 under the bottom surface 115 but the other row of tail portions 126 rearward extend further away from the front surface 116 such that the one row of tail portions 126 are closer to the front surface 116 than the other row of tail portions 126. All the tail portions 126 locate in a single plane (not labeled) such that they are solderable onto the substrate 80. A pair of conductive panels 123 is respectively attached to two opposite elongate ends of the housing 112 each having a section downward extending below the bottom surface 115 of the housing into the single plane.

Referring to FIGS. 5 and 6, the cable end connector 150 is matable with the header connector 110 in a direction parallel with the substrate 80 that the header connector 110 mounts on. The cable end connector 150 provides an elastic latch 152 engaging with a block 130 on the header connector 110 to prevent disengagement of the cable end connector 150 from the header connector 110 due to vibration.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector surface mountable onto a substrate for transmitting power, comprising:

a housing of insulative material including a bottom surface adapted to face a substrate that the connector is surface mountable to, a top surface opposite the bottom surface, and a plurality of passageways between the bottom and the top surface, the housing providing at least two different geometries on the top surfaces thereof in accordance with the passageways such that there is at least one pole that may be inserted into one of the passageways having one geometry but may not be inserted into another one of the passageways having the other geometry; and a plurality of contacts of conductive material assembled to the housing, each contact including a contacting portion at one end thereof, a tail portion at another end thereof and an intermediate portion joining the contacting portion and the tail portion, the contacting portions being received in corresponding ones of the passageways, the tail portion being located under the bottom surface of the housing and being generally parallel to the bottom surface such that the tail portions are surface mountable onto the substrate.

2. The electrical connector as recited in claim 1, wherein stand-offs are provided on the bottom surface.

3. The electrical connector as recited in claim 1 including a pair of conductive panels attached to the housing, each having a section below the bottom surface and being generally parallel with the bottom surface and being surface mountable onto the substrate.

4. An electrical connector surface mountable onto a substrate for transmitting power, comprising:

a housing of insulative material including a bottom surface confronting a substrate that the connector is surface mountable to, a front surface adapted to interconnect a complementary connector, a rear surface distanced from the front surface and a plurality of passageways between the front and the rear surfaces, the housing providing at least two different geometries on the font surface thereof in accordance with the passageways such that there is at least one pole that may be inserted into one of the passageways having one geometry but may not be inserted into another one of the passageways having the other geometry; and a plurality of contacts of conductive material assembled to the housing, each contact including a contacting portion at one end thereof, a tail portion at another end thereof and a n intermediate portion joining the contacting portion and the tail portion, the contacting portions bring received in corresponding ones of the passageways, the intermediate portions extending from the contacting portions and beyond the rear surface of the housing and downward to the tail portions, the tail portions being located in a single plane below the bottom surface of the housing and being generally parallel with the bottom surface such that the tail portions are surface mountable onto the substrate.

5. The electrical connector as recited in claim 4, wherein the tail portions of the contacts are arranged in two rows and wherein one row of tail portions are located closer to the front surface of the housing than the other row of tail portions.

6. The electrical connector as recited in claim 5, wherein said one row of tail portions reversely extend toward the front surface of the housing under the bottom surface of the housing at locations behind the rear surface and the other row of tail portions rearward extend a further distance from the rear surface.

7. The electrical connector as recited in claim 4, wherein stand-offs are provided on the bottom surface of the housing.

8. The electrical connector as recited in claim 4 including a pair of conductive panels attached to the housing, each having a section below the bottom surface and being generally parallel with the bottom surface and being surface mountable onto the substrate.

9. An electrical connector assembly comprising:

a first insulative housing defining a longitudinal direction and a transverse direction perpendicular to said longitudinal direction;

a plurality of passageways defined in the first housing;

a plurality of first contacts respectively received in the corresponding passageways, each of said first contacts defining a surface mounting tail;

a pair of mounting pads disposed on a bottom face of the first housing so as to mount said first housing to a printed circuit board; and a second insulative housing defining a plurality of poles compliantly received in the corresponding passageways, respectively;

a plurality of second contacts respectively disposed in the corresponding poles, and mechanically and electrically engaged to the corresponding first contacts, respectively;

a plurality of wires mechanically and electrically connected to tail sections of the second contacts, respectively; and at least one deflectable latch formed on the second housing to latchably engage a corresponding locking block on the first housing.

10. The electrical connector assembly as recited in claim 9, wherein the first housing provides at least two different geometries on a top surface thereof in accordance with the passageways.

11. The electrical connector assembly as recited in claim 9, wherein stand-offs are provided on the bottom surface of the first housing.

* * * * *